United States Patent [19]

Morters

[11] Patent Number: 4,940,894

[45] Date of Patent: Jul. 10, 1990

[54] ELECTRODE FOR A CORONA DISCHARGE APPARATUS

[75] Inventor: Ronald W. Morters, Waukesha, Wis.

[73] Assignee: Enercon Industries Corporation, Menomonee Falls, Wis.

[21] Appl. No.: 296,457

[22] Filed: Jan. 12, 1989

Related U.S. Application Data

[63] Continuation-in-part of Ser. No. 131,118, Dec. 10, 1987, abandoned.

[51] Int. Cl.[5] ..... H01T 14/00

[52] U.S. Cl. ..... 250/324; 422/186.04

[58] Field of Search ..... 250/324, 325, 326; 361/229, 230; 422/186.04, 186.18

[56] References Cited

U.S. PATENT DOCUMENTS

| | | | |
|---|---|---|---|
| 3,935,517 | 1/1976 | O'Brien | 250/325 |
| 4,239,973 | 12/1980 | Kolbe et al. | 250/325 |
| 4,556,795 | 12/1985 | Tietje | 250/325 |
| 4,649,097 | 3/1987 | Tsukada et al. | 250/326 |
| 4,770,858 | 9/1988 | Collins | 422/186.18 |

*Primary Examiner*—Jack I. Berman

*Attorney, Agent, or Firm*—Quarles & Brady

[57] ABSTRACT

An electrode for a corona discharge apparatus is comprised of a conductor, which can be a stainless steel tube or filament, a metal bar or a rotatable roll, and which is covered by a dielectric, which can be an organic elastomer having a high dielectric constant or quartz or ceramic. The dielectric may be coated with a dielectric adhesive that is loaded with a granulated inorganic dielectric. In most applications a film resistor is inserted between the conductor and the dielectric to reduce any voltage spikes that can result if the corona discharge excites a resonant circuit.

22 Claims, 3 Drawing Sheets

ELECTRODE FOR A CORONA DISCHARGE APPARATUS

RELATED APPLICATIONS

This is a continuation-in-part application of the applicant's copending application for "COMPOSITION ELECTRODE" Ser. No. 131,118 filed on Dec. 10, 1987, now abandoned.

The present invention relates to structures for both the high voltage and the grounded electrodes of high power corona discharge apparatuses. Lower power corona discharge devices have been developed for such purposes as discharging static charges on surfaces of films, or imposing static charges on surfaces of paper and other materials in copying machines, and the like. Such low power corona discharge devices, which often operate on direct current and comparatively low voltages, do not give rise to the problems addressed by the present invention. The present invention addresses problems of high power corona discharge apparatuses which typically employ voltage gradiants of 10 kv to 30 kv and frequencies ranging from 10 kHz to 30 kHz.

Such high power corona discharge devices are widely used in corona treaters for treating the surfaces of films and foils so that inks or glues will adhere to them for printing or laminating purposes, and to a lesser extent in generating ozone for use in water purification and similar applications. The present invention principally concerns the structures of electrodes between which the corona discharge occurs in corona treater stations, where it is frequently desirable to deliver large amounts of energy to the surface of a web being treated so as to achieve the desired surface characteristics without retarding the speed of the web through the corona treater station. The problems solved by the present invention have come to the fore since the 1981 introduction of the first successful bare roll treater, which is disclosed and claimed in U.S. Pat. No. 4,446,110.

High power corona discharge devices require the presence of a strong dielectric between the high voltage electrode and the grounded electrode to prevent the corona discharge from breaking down into an arc. Before 1981, the only known means for maintaining a dielectric between the electrodes that could survive the effects of the electric field, heat and ozone associated with the corona discharge for more than an instant was to use as the grounded electrode a rotating roll on which the web being treated is supported, and to cover that roll with a polymeric dielectric such as Hypalon, silicone rubber or epoxy, or ceramic. That roll coating would be protected from direct exposure to the corona discharge by the web being treated, which rests upon the roll, and the constant rotation of the roll would limit exposure of any portion of the coating to the corona and prevent overheating. Even then, the anticipated life of a dielectric coating on the grounded roll ranges from 3 days to 3 months to years, so the dielectric coating is really an expendable, expensive supply consumed in the corona treating process.

The 1981 introduction of a successful bare roll treater taught the use of a quartz tube filled with aluminum granules for the stationary, high voltage electrode. Several years later, a successful ceramic tube was also developed. A principal advantage of the quartz tube and ceramic tube bare roll treaters is that the quartz or ceramic dielectrics have a permanent life—or should have a permanent life—eliminating the costs of shutdown and replacement of dielectric coatings. The expectation of a permanent life and the use of quartz or ceramic tubes for the stationary electrode introduced a new set of problems.

First, quartz and ceramic, while not fragile, are relatively inflexible and can be shattered or cracked by physical abuse, such as can occur in shipping and handling. Thus a demand for a tougher dielectric material arose. Also, quartz and ceramic tubes are relatively expensive, as well as breakable, giving rise to a desire for a less expensive coating, and one requiring less skill and know-how to manufacture. As the web widths of material to be treated increased requiring longer and longer electrodes, the limitations of the mechanical strength of quartz and ceramic tubes emerged as a limitation on the practicable length of high voltage electrodes, and therefore on the widths of webs that could be treated. Finally, notwithstanding permanent dielectric life of quartz and ceramic tubes in most applications, a peculiar pattern of dielectric breakdowns has been experienced in a small portion of applications, and those breakdowns have proved singularly intractable to solution. In short, what has been sought is a lower cost, easier to manufacture, high voltage electrode that would have greater structural strength, that would be tougher, and that would not be vulnerable to dielectric breakdown in those applications where breakdown otherwise occurs. Also, in the pre-1981 conventional, covered roll stations, the quest for a longer-life, lower-cost roll covering has continued unabated, and the present invention responds to that need. It is the object of the present invention to achieve all of those advantages.

A first step in improving the life of a roll covering is to load the elastomer with a friable inorganic dielectric material that is impervious to heat and ozone, such as aluminum oxide, and the same composition of elastomer with a granular inorganic dielectric can be used as a dielectric covering on a stationary, high voltage electrode. Since the inorganic dielectric granules are impervious to the destructive effects of heat and ozone, the dielectric does not break down from chemical degradation. Quartz tube and ceramic tube high voltage electrodes are also impervious to the effects of corona. Nevertheless, pinholing continues to occur in some applications of both the composition electrodes described above and the quartz/ceramic tube electrodes, even though the integrity of the dielectric material is otherwise unimpaired, and the reason for that pinholing remained, until the present invention, an unsolved mystery.

A part of the present invention is the recognition that such pinholing results from the presence of extraordinarily high voltage transients. However, until the present invention there was no known source for such voltage spikes because the high voltage electrode is supplied by a well regulated power supply generating 10 to 30 kHz at potentials between 10 and 30 kv. Therefore, another part of the present invention is the perception that significant amounts of rf energy are present in the corona discharge as evidenced by the pervasive problem of radio interference from corona treaters. Careful investigation using an especially adapted oscilloscope confirms the presence of a large amount of rf energy in the corona. In addition, the present invention includes the discovery of standing waves on the electrode, explaining the repeated pinholing at specific locations along the length of the electrodes. Finally, the present invention includes recognition of the fact that the leads, electrodes, dielectric, air gap, and corona discharge of the corona treater station, together with the material being treated, create a multitude of resonant circuits, each of which can produce harmonics through a wide band of radio frequencies extending up into the super high frequency range.

Although a corona discharge between the electrodes of a corona treater may give the appearance of a uniform purple glow along the entire length of the electrodes, in fact that the corona discharge consists of billions of minute, individual discharges too small for the unaided eye to detect. Each discharge is capable of exciting a resonant circuit, and if that circuit reaches or approaches resonance simultaneously with pulses of corona of a physical distance corresponding to a fraction of a wavelength, a voltage spike of enormous amplitude can result that readily pierces the dielectric causing pinholes. This phenomenon is manifested by the presence of measurable standing waves at the electrodes that add amplitude to the resonant voltage spike.

The present invention significantly reduces, if not eliminates, such pinholing by adding resistance in series with the resonant circuit to lower the Q of the resonant circuit, thus flattening and prolonging the voltage peak at resonance and thereby reducing the voltage and extending the charge and discharge time of the capacitor created by the dielectric. This is achieved by depositing of a carbon film resistance on the electrode conductor between the conductor and the dielectric coating.

In addition to solution of the pinholing problem, the present invention also addresses the problems of cost of manufacture and efficiency of operation. Premium quality high voltage electrodes made of a quartz tube filled with a powdered conductor, typically aluminum, are available, but quartz tends to be somewhat brittle, requiring special handling, and the dielectric strength of quartz varies inversely with temperature, so the quartz electrode is subject to avalanche electrical breakdown if it is not adequately cooled. Ceramic tube electrodes are tougher than quartz and less vulnerable to heat, but ceramic tubes are even more expensive. Since quartz and ceramic tube electrodes depend upon the quartz and ceramic tubes for mechanical strength, the length of such an electrode—and hence the width of the sheet material treated—is limited by the structural strength of quartz and ceramic.

According to the present invention in its preferred embodiment, those problems can be reduced by using for a conductor a tube of metal, such as stainless steel, and covering it with an elastic, silicone rubber tube, taking care to fill all possible voids between the metal tube and the silicone rubber with a silicone rubber sealant. Since silicone rubber is vulnerable to degradation from the corona discharge, its exterior is also coated with silicone rubber adhesive which is then loaded with granulated aluminum oxide, or other inorganic dielectric granules, and allowed to set. When put into use, the corona will corrode away any exposed silicone rubber, leaving a rough surface of projecting inorganic dielectric particles. Since a gaseous discharge occurs at significantly lower voltages from points than from a smooth, flat, surface, the electrode made as just described operates at a lower voltage and lower heat than a smooth electrode due to the lesser contact area of the corona to the points of discharge. Hence it operates more efficiently, and it is less vulnerable to degradation. Since the metal tube conductor supplies its structural strength, this electrode can be made much longer than a quartz or ceramic tube electrode. Also, an electrode made as described above is less expensive and less vulnerable to mechanical damage than a quartz or ceramic tube electrode.

For the grounded roll of a corona treater station, a preferred embodiment of the present invention provides further economies by taking advantage of the dielectric shielding provided by the plastic web being treated, which is supported by the surface of the grounded roll and thus isolates it from the corona. This allows use of epoxy, instead of silicone rubber, without loss of durability, even though epoxy rapidly deteriorates when exposed to a corona discharge. Not only is epoxy less expensive than silicone rubber, a fluidized bed of epoxy and inorganic dielectric granules can be electrostatically spray coated onto the surface of the grounded roll, minimizing production costs to reduce total costs even further with a more reliable coating due to the elimination of air entrapment that occurs when liquid binders are used separately to hold the granules. Since the inorganic dielectric granules have a high dielectric constant, and the epoxy has high dielectric strength with a relatively low dielectric constant, the corona discharge tends to be uniformly distributed among the inorganic dielectric surface granules, generating an even, uniform corona without spiking or channeling. This enhances the treating efficiency of the corona.

The foregoing and other objects and advantages of the invention will appear from the description that follows. In that description, reference is made to the accompanying drawings which form a part hereof, and in which there is shown by way of illustration preferred embodiments of the invention. Since such embodiments do not necessarily represent the full scope of the invention, reference is directed to the claims herein for interpreting the scope of the invention.

DESCRIPTION OF THE PREFERRED EMBODIMENT

Figure 1:
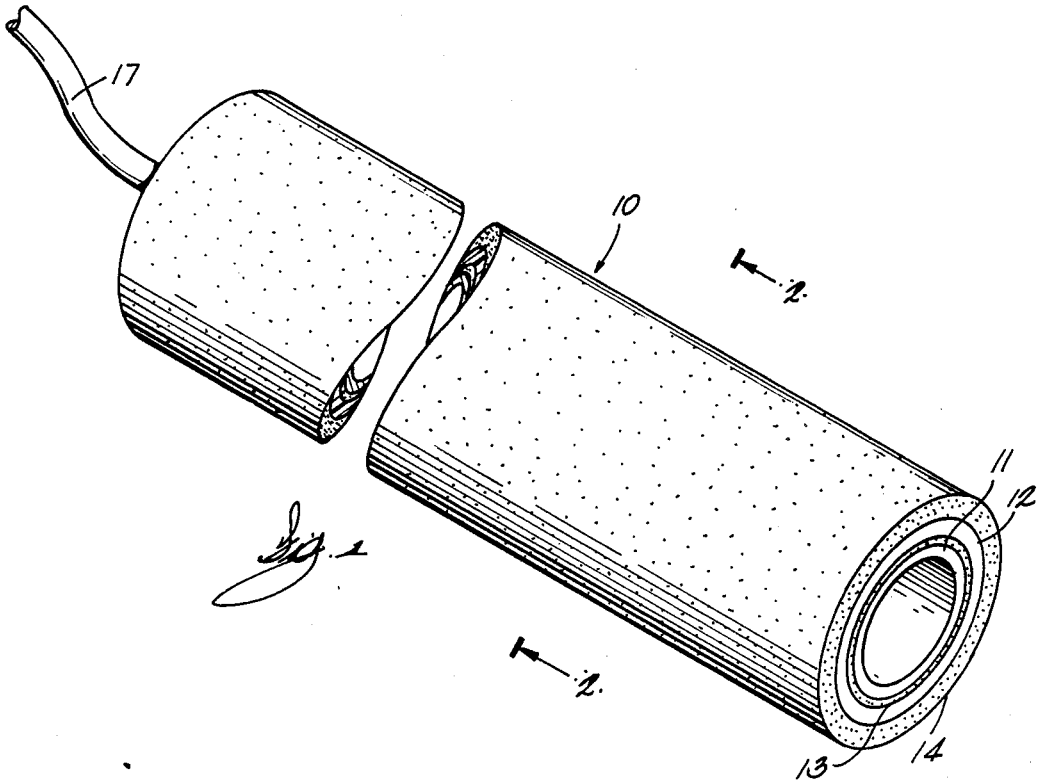
FIG. 1 is a perspective view of the electrode of the present invention.
Figure 3:
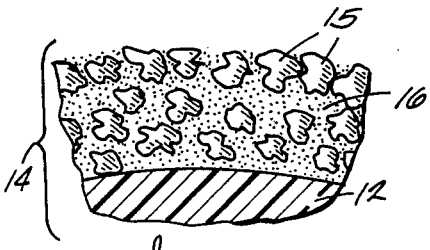
FIG. 3 is an enlarged view of the outer layer of the electrode 1.
Figure 2:
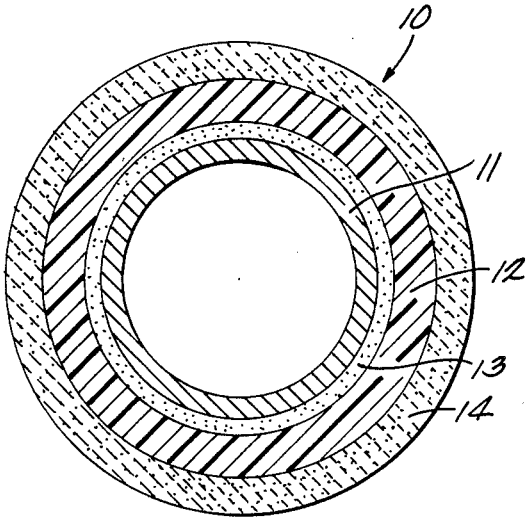
FIG. 2 is a sectional view taken along the plane 2—2 in FIG. 1.

Referring to the drawings, there is seen in FIG. 1 an electrode 10 having a tubular core 11. As seen best in FIG. 2, which is not to scale, an intermediate dielectric layer 12 is bonded to the core 11 with a continuous, dielectric adhesive layer 13 so that a void free interface exists. The outer surface of the intermediate dielectric layer 12 is covered by an outer dielectric layer 14 which, as seen best in FIG. 3, is comprised of particles of a dielectric material 15 which are bonded to the outside of the intermediate layer 12 by a dielectric adhesive 16. A conductor 17 is seen in FIG. 1; it is provided for electrically connecting the core 11 to an electrical source (not shown).

In the preferred embodiment of the electrode, the conductive core 11 is a metal tube, preferably of stainless steel although other metals including aluminum can be used. The dimensions of the core 11 are determined by the intended application for the electrode. In an embodiment for use in a corona treatment, the core 11 may be a stainless steel tube having an outer diameter of ½ inch and a wall thickness of 1/32 inch. The length of the tube depends upon the intended application for the electrode, e.g., the width of the corona treatment section.

The preferred intermediate dielectric layer 12 comprises a silicone rubber sleeve having an inner diameter which is sized to closely receive the core 11 with an integral continuous, voidless adhesive layer 13. The silicone rubber sleeve has a wall thickness of about 1/16 inch and is of the same length as the tubular core. Suitable silicone rubber sleeves are readily available from a number of manufacturers of silicone rubber tubing. The term "silicone rubber" as used herein is intended to cover other materials which function in a manner equivalent to silicone rubber under the conditions of use.

The adhesives which are preferred for use in construction of the electrode 10 are preferably silicone rubber adhesives. The adhesives are commercially available from the Silicone Products Department of General Electric Co. and the Dow Corning Corp. These and other suitable adhesives are described in detail in the Handbook of Silicone Rubber Fabrication by Wilfred Lynch, published by Van Nostrand, Reinhold Company, 1978. In addition to the described adhesives, other adhesives can be used which function in an equivalent manner.

The outer dielectric layer 14 preferably is formed by coating the outside of the silicone sleeve with the dielectric adhesive 16 and embedding particles of a friable dielectric material 15 in the adhesive. The distribution of the particles in the layer 14 should be uniform so that the emissions from the electrode are uniform.

Particles of any suitable inorganic dielectric material or combination of such materials may be employed. It is only necessary that the dielectric particles be of the desired size and the desired resistivity (e.g. greater than $10^6$ ohm centimeters). Typical inorganic dielectric materials include metal oxides such as the preferred oxides of aluminum, and oxides of zinc, magnesium, titanium, barium, beryllium, calcium, cerium, strontium, zirconium, thorium, and hafnium. Typical inorganic dielectric materials further include ceramic materials such as silicon nitride, silica, silicon, boron nitride, zirconium silicate, titanates such as lead, barium and calcium, ferrites such as zinc, aluminum and magnesium and glasses such as phosphosilicate glasses, borosilicate glasses and metallic oxide additions thereto.

The foregoing material specifications apply equally both to this embodiment and to the other embodiments described below. Though these material specifications will not be repeated in the descriptions of those embodiments, those descriptions should be read to contain these specifications.

As previously mentioned, the electrode of the present invention provides several advantages over previously available electrodes. For example, since the metal tubing and the silicone rubber sleeves are available in practically any length, it is relatively easy and simple using the method of the present invention to make a one-piece electrode that can bridge the width of the entire treatment area of a corona treatment device. It is well-known that in solids the ability of a material to conduct heat varies directly with its ability to conduct electricity. Hence, among dielectrics silicone rubber is one of the better conductors of heat and its heat conduction is markedly increased when it is loaded with inorganic granules such as aluminum oxide. Also, the creation of tight seals between the layers greatly increases the heat conduction. Nevertheless, the silicone rubber sleeves 12 with the coating 14 of silicone rubber adhesive 16 loaded with aluminum oxide 15 provides sufficient thermal insulation to materially limit the amount of heat that could be exhausted through the interior of the stainless steel tube 11. That limitation together with the cooler operation of this electrode and the limitation of the contact of the corona with the electrode to the points of the granules 15 obviates the need for auxiliary cooling through the tube 11.

Figure 4:
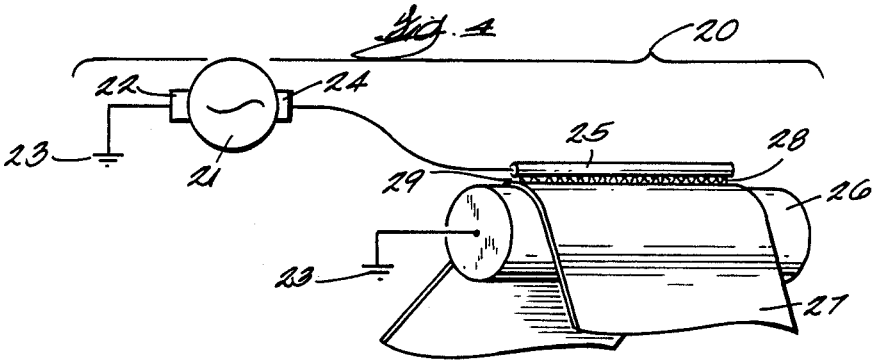
FIG. 4 is a diagramatic representation of a corona treater station that would utilize the present invention.

FIG. 4, diagramatically illustrates a corona treater system 20 that utilizes the present invention. The corona treater system 20 includes a high voltage, high frequency power supply 21 that has one output terminal 22 connected to a ground return 23 and the other output terminal 24 connected to energize a high voltage electrode 25 that is mounted parallel to and spaced from a grounded electrode 25 in the form of the rotatable roll 26 that is connected to the ground return 23. The grounded roll 26 supports a web of plastic material 27 to be treated that passes through an air gap 28 between the grounded roll 26 and the high voltage electrode 25. The air gap 28 formed between the high voltage electrode 25 and the grounded roll 26, is about 1/16th inch wide, and supports a corona discharge 29 when the high voltage electrode 25 is energized by the power supply 21. The web 27, passing through the air gap 28, is thus exposed to the corona 29 which modifies its surface as desired.

Figure 5:
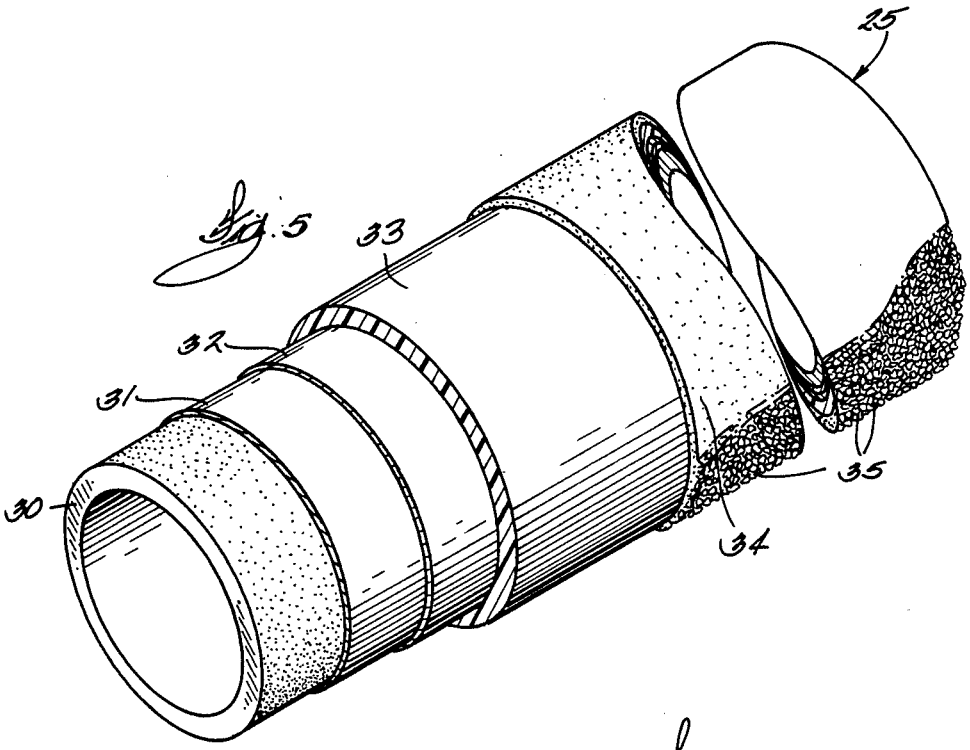
FIG. 5 is a high voltage electrode embodying the present invention with portions broken away to reveal its structure.

FIG. 5 illustrates a high voltage electrode 25 embodying the present invention for use in a corona treater, and layers are broken away to reveal its internal structure. The inner most layer shown in FIG. 5 is a stainless steel electrode conductor 30. As a resistor in series with the conductor, a graphite film 31 is deposited on the exterior surface of the stainless steel tube electrode 30. A silicone rubber adhesive coating 32 applied over the surface of the graphite film resistor 31 forms a part of the dielectric over the stainless steel tube electrode 30. Next, a silicone rubber tube 33 surrounds the sealant coating 32. The adhesive coating 32 serves to bond the silicone rubber tube 33 to the electrode, and to fill and eliminate all voids or air pockets that might otherwise occur between the graphite film resistor 31 and the silicone rubber tube 33. A coating of silicone rubber adhesive 34 is applied to the outside surface of the silicone rubber tube dielectric 33, and granules of the aluminum oxide 35, which serves as an inorganic dielectric impervious to the destructive effects of the corona 29, are embedded in the silicone rubber adhesive 34 to completely cover its surface. A portion of this high voltage electrode 25 is shown in section in FIG. 6.

Figure 6:
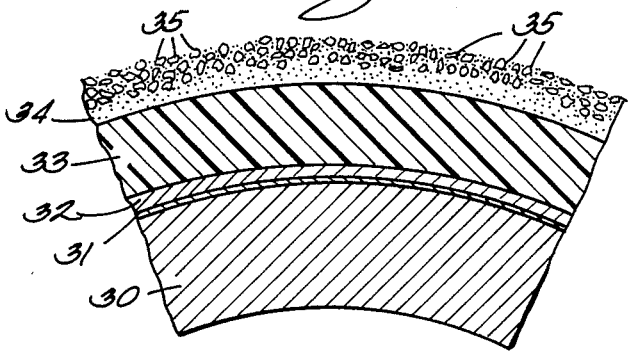
FIG. 6 is a portion in section of the high voltage electrode shown in FIG. 4.

In FIG. 6, the granular aluminum oxide exterior 35 is somewhat more visible, and its presentation of discharge points shown more clearly. The particle size of the aluminum oxide 35, or other material, should range between 14 mesh and 300 mesh. If the particles 35 were too small, the aluminum oxide coating would lose the ability to present discharge points which, when present, allow it to operate at a much lower voltage than a uniform, smooth surface. The use of a granular aluminum oxide 35 generating discharge points can reduce the discharge voltage to one-third of the voltage required for a discharge from a smooth surface, and as a consequence, the corona is significantly cooler and the system operates more efficiently. The graphite film resistor 31 is applied as a water base colloidal suspension of graphite, and when dried, is about 1 mil thick. The film resistor 31 should have a resistance ranging from 100 to 5,000 ohms per square, and in the reduction to practice a 400 ohm per square film was used. The descriptions of these materials set forth in connection with the first embodiment shown in FIGS. 1, 2 and 3, apply equally to this embodiment.

Figure 7:
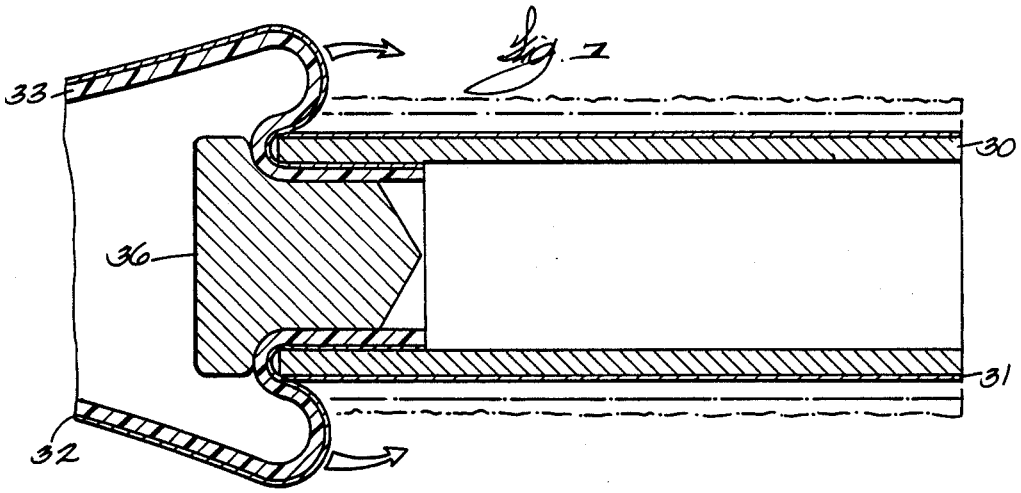
FIG. 7 is a longitudinal section of a high voltage electrode as shown in FIGS. 4 and 5 illustrating the manner in which such an electrode is assembled.

FIG. 7 illustrates the manner in which the high voltage electrode 25 shown in FIGS. 5 and 6 is made. The silicone rubber tube 33 is secured inside of the stainless steel conductive electrode 30 with a bung 36. The graphite film resistor 31 is coated on the outside of the stainless steel conductor 30, and after it has dried, a coating of primer is painted on it. The outside of the silicone tube 33 is coated with a heavy layer of a silicone rubber adhesive 32 such as SR 141 resin and the solvent is allowed to evaporate off. When the solvent of the resin coating 32 has evaporated, the silicone rubber tube 33 is rolled over the stainless steel tube electrode 30, turning the silicone rubber tube 33 inside out, and forming a tight bond between the silicone rubber tube 33 and the graphite layer 31 on the stainless steel tube conductor 30. The force of the silicone rubber tube 33 squeezing the resin coating 32 forces the resin 32 to flow and fill any void that exists, any excess resin 32 flowing out at the end.

The importance of filling all voids and eliminating any air entrapment is emphasized because when the high voltage electrode 25 is put into use, corona will develop in any voids that are present. A corona entrapped in a void between the electrode 30 and the silicone rubber tube 33 would soon destroy the electrode 25.

After the silicone rubber tube 33 is rolled on over the graphite film resistor 31 on the stainless steel conductor tube 30, the thick coating of the silicone rubber adhesive 34 is applied to the outside surface of the silicone rubber tube 33, and then the aluminum oxide granules 35 are embedded in it before it vulcanizes. One way of embedding the aluminum oxide granules 35 into the silicone rubber 34 is to roll the tube in a pan of aluminum oxide granules 35 until the silicone rubber is filled with aluminum oxide 35.

This structure provides a conductor, which is the stainless steel tube 30, in series with a resistor, which is the graphite film 31, which in turn is in series with the dielectric consisting of the silicone rubber adhesive layer 32 plus the silicone rubber tube 33 plus the adhesive coating 34 loaded with aluminum oxide 35. Although the air gap 28 could serve as a dielectric when it is ionized and a corona discharge 29 established, the corona is a negative resistance conductor. Thus a series resonant RC circuit exists, but owing to the film resistance 31, it has a low Q.

Figure 8:
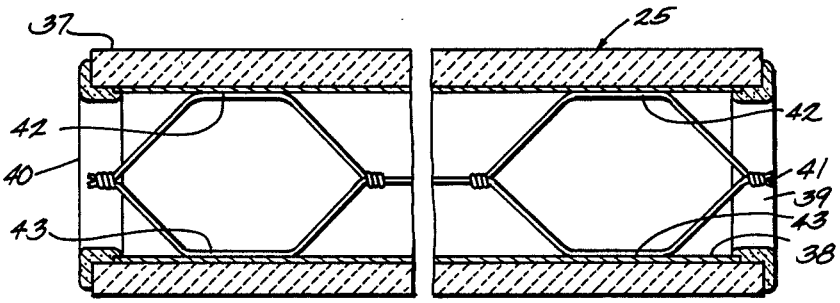
FIG. 8 is a view in longitudinal section of a ceramic tube electrode embodying the present invention.

FIG. 8 illustrates another embodiment of the invention in a high voltage electrode 25. In this embodiment, the electrode 25 consists of a ceramic tubing 37 that may have either a square, rectangular or round cross section. The tube 37 could also be quartz. The inside surface of the ceramic tube 37 has a graphite film 38 applied to it to form a film resistor 38. A silicone rubber shroud 39 and 40 is formed over each end of the ceramic tube 37 to cover the inside surface of the ceramic tube 37 and the end of the graphite film resistor 38 to prevent any corona discharge or arcing from the ends of graphite film resistor 38. An electrode conductor 41 is a 0.012" diameter, or 300 micron stainless steel wire 41 that is doubled over and twisted together at regular intervals to form contact areas 42 and 43 where the wire conductor 41 is resiliantly held in tight contact with the graphite film resistor 38. Although not shown in FIG. 8, if desired to minimize the discharge voltage or the operating temperature, the surface of the ceramic tube 37 may also be coated with a silicone rubber adhesive that is loaded with an inorganic dielectric, such as aluminum oxide granules, as described in the previous embodiments.

Figure 9:
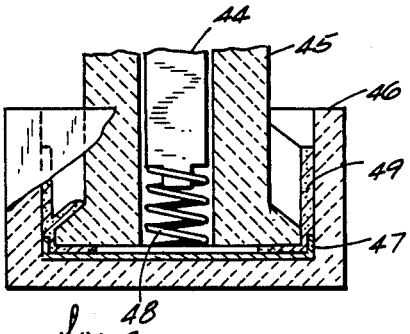
FIG. 9 is a ceramic electrode segment for a segmented electrode embodying the present invention with portions broken away to reveal its structure.

In some installations, it is desirable to utilize with a bare roll treater a segmented high voltage electrode made up of a row of electrode segments that may be individually removed or replaced, either to treat only certain portions of a substrate, or to conform the length of the electrode to different widths of substrates being treated. In such electrode assemblies, each electrode segment consists of an electrode conductor housed in its own separate dielectric enclosure and connected to a high voltage, high frequency power source. FIG. 9 is a portion of such an electrode segment partially in section to illustrate its structure and the application of the present invention to it. In this embodiment, the electrode conductor is a thin bar of conductive metal 44, typically aluminum. The conductive bar 44 is located in a hollow ceramic sleeve 45 which fits in a ceramic boot 46. A film of graphite resistance 47 is deposited on the floor and part way up the walls of the inside surface of the ceramic boot 46. Contact between the bar of conductive metal 44 and the graphite film resistor 47 is achieved by means of a stainless steel compression spring 48. A ceramic adhesive seal 49 is formed over the upturned edge of the graphite film resistor 47 to eliminate any air that could form a medium for corona discharge within the ceramic boot 46. The ceramic adhesive layer 49 can also serve to cement the ceramic boot 46 to a ceramic sleeve 45.

Figure 10:
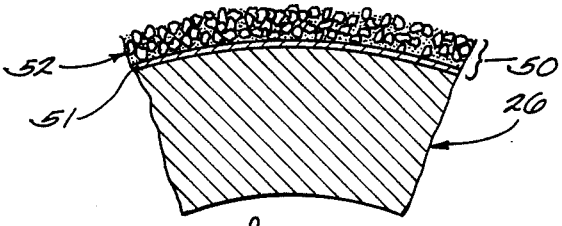
FIG. 10 is a partial view in section of a grounded roll electrode embodying the present invention.

The present invention can also be employed in a conventional, covered roll corona treater station by utilizing it in the roll covering as shown in FIG. 10. FIG. 10 shows a portion in section of the grounded roll 26 of a corona treater station having a roll covering 50. The roll covering 50 according to the present invention consists of two layers, one being a graphite resistive film 51 coating the outside of the grounded roll 26. A dielectric covering consisting of epoxy loaded with aluminum oxide granules 52 is deposited over the graphite resistive film 51. The dielectric layer 52 is spray coated on the graphite resistive film 51 covered roll 26 from a single spray gun in a single operation, and this not only simplifies and reduces the cost of manufacture, but it also eliminates any possible air entrapment or voids in which a corona discharge might be generated.

Normally the relatively inexpensive epoxy could not economically be used for a dielectric in a corona discharge apparatus, but in this context, the web 27 to be treated shields the roll covering 50 from direct exposure to the corona discharge 29 and the rotation of the roll 26 prevents heat built up, so the use of epoxy becomes economically feasible. Even in this setting, any exposed epoxy will quickly erode away, leaving the projecting points of aluminum oxide granules for a surface coating. However, that phenomenon enhances the life of the roll covering 52 by further isolating the epoxy from the effects of corona discharge 29, and improves the operation of the roll covering 52 by providing numerous point discharges to effect a uniform smooth corona discharge over the entire surface. By weight, the dielectric layer 52 is 85% aluminum oxide and 15% epoxy, and by volume the dielectric layer 52 is 60% aluminum oxide and 40% epoxy. Since the aluminum oxide has a dielectric constant approximately three times that of the epoxy, the capacitive conductance of electrical energy occurs principally through the aluminum oxide with minimal lateral discharge between granules of aluminum oxide owing to the lower dielectric constant of the epoxy, thereby limiting the discharge area for each corona discharge.

The foregoing describes in detail certain preferred embodiments of the present invention and the best modes presently contemplated for carrying out this invention. However, the invention is not limited to those specific embodiments, but it is set forth in the claims that follow.

As my invention, I claim:

1. In an electrode for a high frequency high voltage corona treater, the electrode having a conductive core and a dielectric covering, the improvement which comprises the core being a tube of conductive material and the dielectric covering comprising an intermediate dielectric layer and an outer dielectric layer; said intermediate dielectric layer being bonded to the core in a continuous substantially voidless manner; and said outer dielectric layer being comprised of particles of high dielectric material bound together and to the intermediate dielectric layer by a dielectric adhesive.

2. An electrode of claim 1 in which the tube is of stainless steel.

3. An electrode of claim 1 in which the intermediate dielectric layer is of silicone rubber.

4. An electrode of claim 1 in which the particles of dielectric material are particles of aluminum oxide.

5. An electrode of claim 1 in which the dielectric adhesive is a RTV silicone adhesive.

6. A grounded roll for a high frequency high voltage corona treater comprising the combination of an electrically conductive cylindrical roll mounted to rotate about its longitudinal axis and being electrically grounded;

a resistive film on the cylindrical surface of said electrically conductive roll in uniformly tight electrical engagement with said cylindrical surface;

a dielectric covering deposited over said resistive film with substantially no voids between said dielectric covering and said resistive film;

said dielectric covering comprising a substantially uniform mixture of granules of inorganic material having a high dielectric constant with a binder having high dielectric constant with a binder having high dielectric strength but a comparatively low dielectric constant.

7. A grounded electrode for a high frequency high voltage corona treater said grounded electrode comprising a conductor adapted for electrical connection to electrical ground;

a layer of dielectric material covering at least as much of the surface of said conductor as would otherwise be exposed to corona discharge;

and a resistive, but not insulating, film between and in uninterrupted electrical contact with said surface of said conductor and said layer of dielectric material.

8. A grounded electrode for a high frequency high voltage corona treater as set forth in claim 7 wherein said conductor is a cylindrical roll mounted to rotate about its longitudinal axis;

said layer of dielectric material surrounds the cylindrical surface of said cylindrical roll;

and said resistive film covers said cylindrical surface of said cylindrical roll.

9. A grounded electrode for a corona treater as set forth in claim 7 wherein said dielectric material is a mixture of granules of an inorganic dielectric material suspended in an organic elastomeric binder.

10. A grounded electrode for a corona treater as set forth in claim 9 wherein said inorganic dielectric material is aluminum oxide;

said elastomeric binder is epoxy;

and said mixture is substantially uniform throughout.

11. A grounded electrode for a corona treater as set forth in claim 10 wherein said mixture is by volume approximately 85% aluminum oxide and 15% epoxy, and by weight approximately 60% aluminum oxide and 40% epoxy.

12. A grounded electrode for a corona treater as set forth in claim 7 wherein said resistive film is a carbon film.

13. A grounded electrode for a corona treater as set forth in claim 7 wherein said dielectric material is comprised of a substantially uniform mixture of granules of a material having a high dielectric constant and a binder having high dielectric strength.

14. A high voltage electrode for a high frequency corona discharge apparatus, said high voltage electrode comprising the combination of a conductor adapted for connection to a high voltage high frequency power source and to emit a corona discharge from a predetermined area of its surface;

a resistive, but not insulating, film covering said predetermined area of the surface of said electrode so as to have substantially uninterrupted electrical contact over said entire surface; and a layer of dielectric material enveloping at least all surfaces of said conductor likely to emit a gaseous discharge and covering said resistive film in substantially uninterrupted electrical contact with said resistive film.

15. A high voltage electrode for a high frequency corona discharge apparatus as set forth in claim 14 wherein said layer of dielectric material is a preformed structurally rigid material having high dielectric strength;

and said resistive film is deposited on an inside surface of said dielectric material.

16. A high voltage electrode for a high frequency corona discharge apparatus as set forth in claim 15 wherein said preformed structurally rigid material is ceramic.

17. A high voltage electrode for a high frequency corona discharge apparatus as set forth in claim 16 wherein said preformed structurally rigid material is quartz.

18. A high voltage electrode for a high frequency corona discharge apparatus as set forth in claim 15 wherein said layer of dielectric material is an elongated tube of dielectric material;

said resistive film is deposited on the inside surface of said tube;

and said conductor is a filament of conductive material formed to engage said resistive film in tight electrical contact at predetermined areas opposite areas of the outside surface of said elongated tube of dielectric material from which emission of a corona discharge is discharged.

19. A high voltage electrode for a high frequency corona discharge apparatus as set forth in claim 14 wherein said conductor is a rigid elongated structural shape having high tensile strength;

said resistive film is deposited over the elongated surface of said conductor;

and said dielectric layer surrounds said resistive film.

20. A high voltage electrode for a high frequency corona discharge apparatus as set forth in claim 19 wherein said dielectric layer is a silicone rubber tube sealed to said resistive film by silicon rubber cement and having a layer of aluminum oxide granules affixed to its external surface by silicon rubber cement.

21. A high voltage electrode for a high frequency corona discharge apparatus as set forth in claim 20 wherein said conductor is a stainless steel tube.

22. A corona discharge apparatus comprising the combination of a pair of conductors adapted for connection to opposing terminals of a high frequency high voltage source of electrical energy and adapted to create a corona discharge between said pair of conductors when energized by said high frequency high voltage source;

a layer of dielectric material covering at least as much of the surface of one of said electrodes as would otherwise be exposed to said corona discharge;

and a resistive, but not insulating, film between and in electrical contact with said surface of one of said electrodes and said layer of dielectric material.

* * * * *